United States Patent [19]

Tseng

[11] Patent Number: 4,871,164

[45] Date of Patent: Oct. 3, 1989

[54] CYCLE EXERCISER

[76] Inventor: D. H. Tseng, No. 116, Mei Kang Rd., Mei Kang Village, Ta Tsun Hsiang, Chang Hua Hsien, Taiwan

[21] Appl. No.: 337,927

[22] Filed: Apr. 14, 1989

[51] Int. Cl.[4] ..... A63B 21/00; A63B 69/06

[52] U.S. Cl. ..... 272/73; 272/72

[58] Field of Search ..... 272/73, 72, 131, 132, 272/901, 67, 116, 97

[56] References Cited

U.S. PATENT DOCUMENTS

| | | | |
|---|---|---|---|
| 326,247 | 9/1885 | Root | 272/71 |
| 4,657,244 | 4/1987 | Ross | 272/73 |
| 4,660,826 | 4/1987 | Lee | 272/73 |

*Primary Examiner*—Stephen R. Crow

*Attorney, Agent, or Firm*—Rogers, Howell & Haferkamp

[57] ABSTRACT

A cycle exerciser having a one-way sprocket and a pair of one-way pinions disposed on a compound shaft. The one-way sprocket is rotated by a pedaling mechanism through a chain. The one-way pinions are respectively rotated by a pair of lever arms through a respective toothed element and a connecting mechanism. The toothed element engages and rotates the one-way pinion. The connecting mechanism comprises a substantially cylindrical swivel block and a torsional spring. The swivel block has a rim portion for fixedly securing to the toothed element and a protruding swivel shaft for telescopically receiving one end portion of the lever arm. The connecting mechanism, which is fixed to the toothed element by the rim portion thereof, connects to the lever arm in such a way that the lever arm can perform oscillatory and swiveling movement like rowing boats. The compound shaft is arranged to drive an energy absorbing wheel.

4 Claims, 7 Drawing Sheets

CYCLE EXERCISER

BACKGROUND OF THE INVENTION

This invention relates to an improved type of cycle exerciser, which is capable of smoothly providing exercise for both the upper part and lower part of the body and providing a simulated rowing function.

In recent years there has been a need for a bicycle type exerciser which operates as a conventional exercise bicycle, but which is also capable of providing exercise for muscle groups in the upper part of the body. Such an exerciser is designed to provide exercises or activities which may compete with jogging and running.

One cycle exerciser that has been marketed in recent years by Schwinn is protected by Hooper (U.S. Pat. No. 4,188,030). The Hooper cycle exerciser includes elongated handle bars which are utilized to exercise the muscles in the upper part of the body. Particularly, two eccentrics are arranged 180 degrees out of phase and are connected to the foot pedal assembly so as to rotate in response to both pivotal movement of the handle bars and operation of the foot pedals.

Another particular exercise bicycle which can also provide exercise for both the lower and upper part of the body, but which uses a different system for mounting the arm lever, is disclosed by Ross in U.S. Pat. No. 4,657,244. Tihs exercise bicycle has a first gear in mesh with a second larger gear and rotating with a flywheel. Located on the face of the second gear, but offset from the center of the gear, is an eccentric which supports reciprocating arms. Movement of the reciprocating arms by the user causes rotation of the second and first gears and, consequenlty the flywheel. In operation, the arm levers are reciprocated or moved forwards and backwards. At one extreme point, the right arm lever would be forward and the left arm lever would be rearward, and at the other extreme point the positions would be reversed.

Both the exercisers disclosed by Hooper and Ross have extreme points for the handle bars or arm levers, and therefore for the eccentrics thereof, so that the handle bars or arm levers do not function properly, or do not operate at all, at these extreme points. In addition, a confined or limited range of movements are determined between opposite extreme points due to the inherently structural properties of the eccentrics such that the user cannot fully stretch his arms but has to accommodate the pre-determined construction of the exerciser. Also, as it is near the extreme points or away from the extreme points, the forces required to operate the handle bars or arm levers are different; i.e., the force applied to the handle bars or arm levers are not even or smooth.

SUMMARY OF THE INVENTION

This invention does not utilize any eccentric mechanism and no extreme points are present herein as inherently existed in the above-described prior arts which utilize eccentrics.

The cycle exerciser of this invention is constructed in the manner of a conventional exerciser bicycle with a frame, foot pedal means, an energy absorbing wheel, and a chain drive system to link the foot pedal to the energy absorbing wheel. A compound shaft is provided to support a one-way sprocket is rotated by the foot pedal means. Connecting means cooperating with a toothed element are disposed between each lever arm and the corresponding one-way pinion so that movement of the lever arms also drives the one-way pinions. It is noted that the toothed element drives the one-way pinion in an even and smooth way; i.e., no above-mentioned extreme points or uneven forces are present. Also, both lever arms can be simultaneously employed or individually selected to drive the corresponding one-way pinion in a versatile way, through the toothed element to the compound shaft, which subsequently rotates the energy absorbing wheel. The connecting means, incorporating a torsional spring therein, allows the lever arms to swivel laterally like a row boat. The toothed element can be replaced by a serially connected drive chain and spring. The conjunction of the drive chain and spring is disposed between a corresponding one-way pinion and lever arm to facilitate the same operation.

Therefore, to mitigate and/or obviate the above-mentioned prior art drawbacks, a primary objective of this invention is to provide a cycle exerciser which provides exercise for the upper part and lower part of the body in a versatile way, particularly providing a simulated rowing function.

These and additional objects, if not set forth specifically herein, will be readily apparent to those skilled in the art from the detailed description providing hereinbelow, with appropriate reference to the accompanying drawings.

DETAILED DESCRIPTION OF THE PREFERRED EMBODIMENTS

Figure 1:
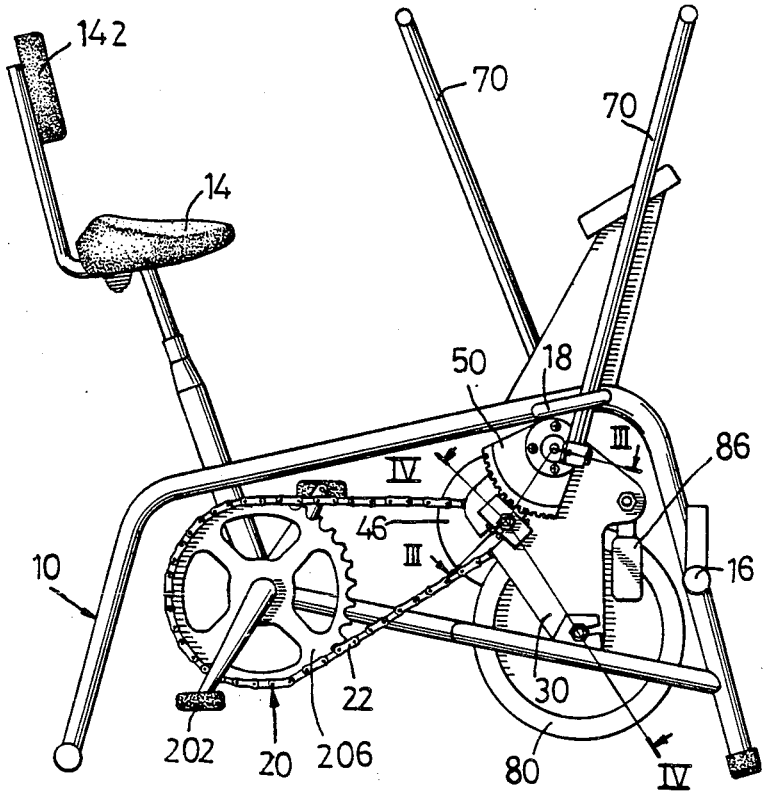
FIG. 1 is a side view of a cycle exerciser in accordance with the present invention.

Referring now to the specific embodiment of this invention shown in FIGS. 1 through 6, and more particularly to FIGS. 1 to 4, the cycle exerciser includes a frame 10, a seat 14, pedaling means 20 and an energy absorbing wheel 80.

Figure 2:
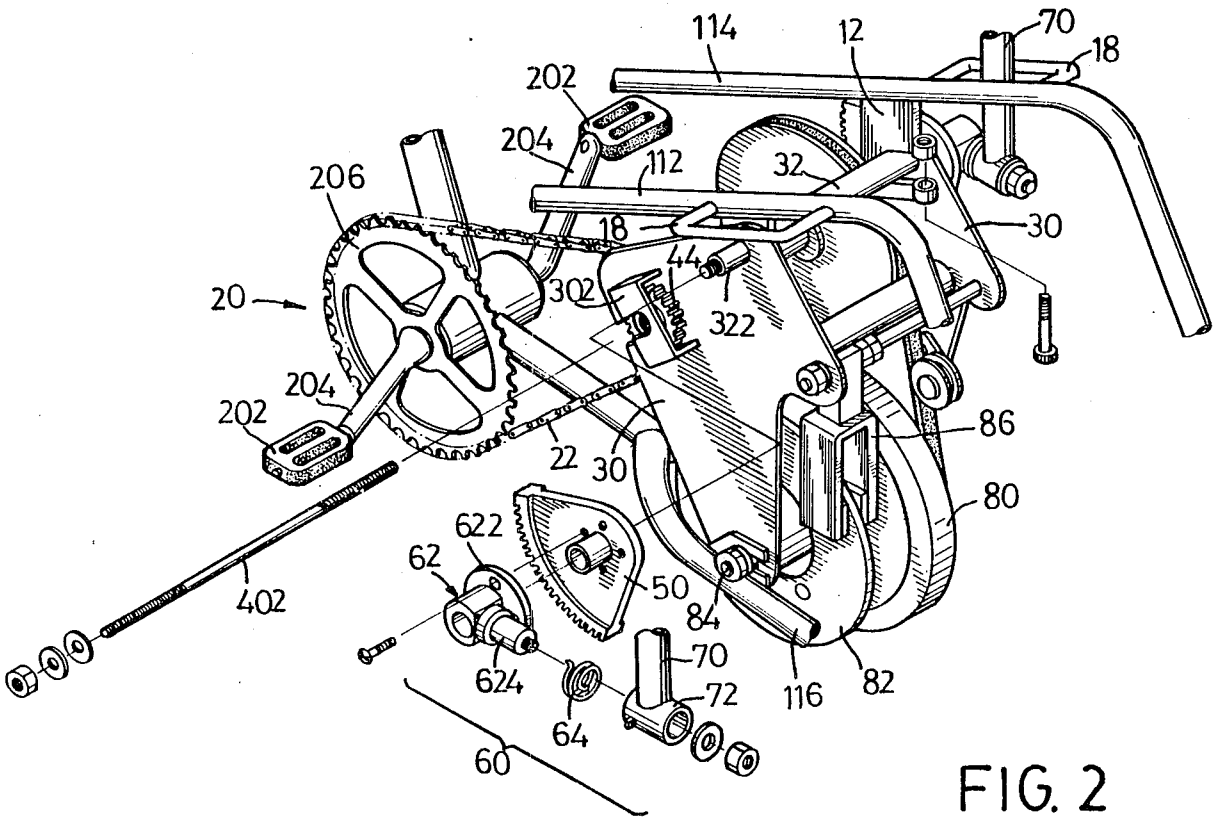
FIG. 2 is a partially exploded view of the cycle exerciser of FIG. 1.

The frame 10 has a pair of supporting plates 12 extending downward therefrom. Upper right and upper left members 112, 114 of the frame 10 have a set of closed bars 18 respectively disposed thereon, as shown in FIG. 2. A pair of frame plates 30, parallel to each other, are respectively secured to the supporting plates 12 of the frame 10 at an upper position by a support rod 32 which passes through both the frame plates 30 and the supporting plates 12. A lower portion of each frame plate 30 is also secured to a respective lower member 116 of the frame 10 to form a firm support. The support rod 32 is fixedly disposed across the pair of frame plates 30 with two opposite ends 322 extending outward from the frame plates 30. A respective cover plate 302 is fixed on each of the frame plates 30.

Figure 3:
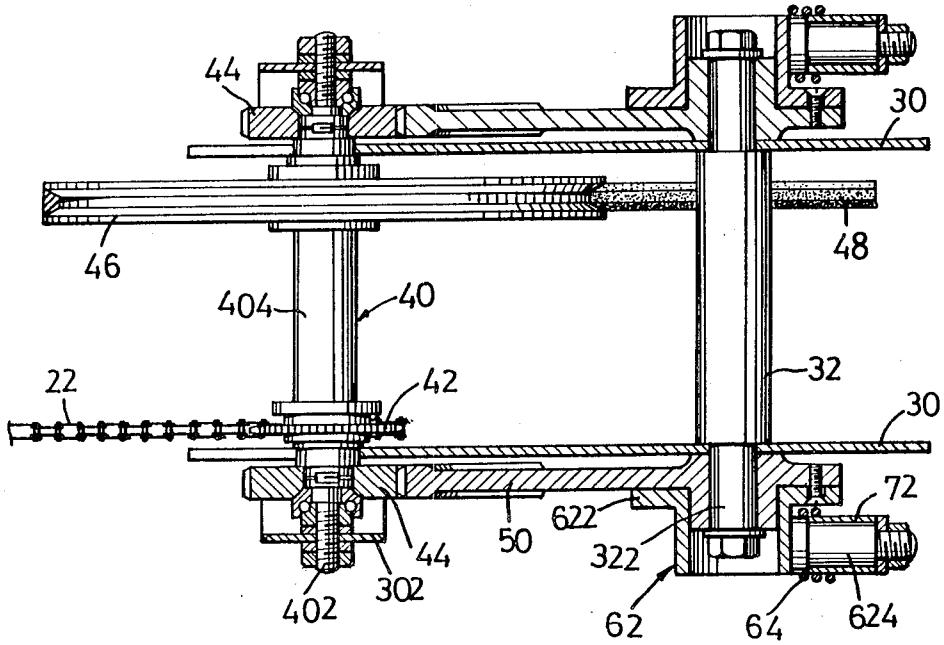
FIG. 3 is a cross-sectional view of the cycle exerciser of FIG. 1 as seen from line III—III.
Figure 4:
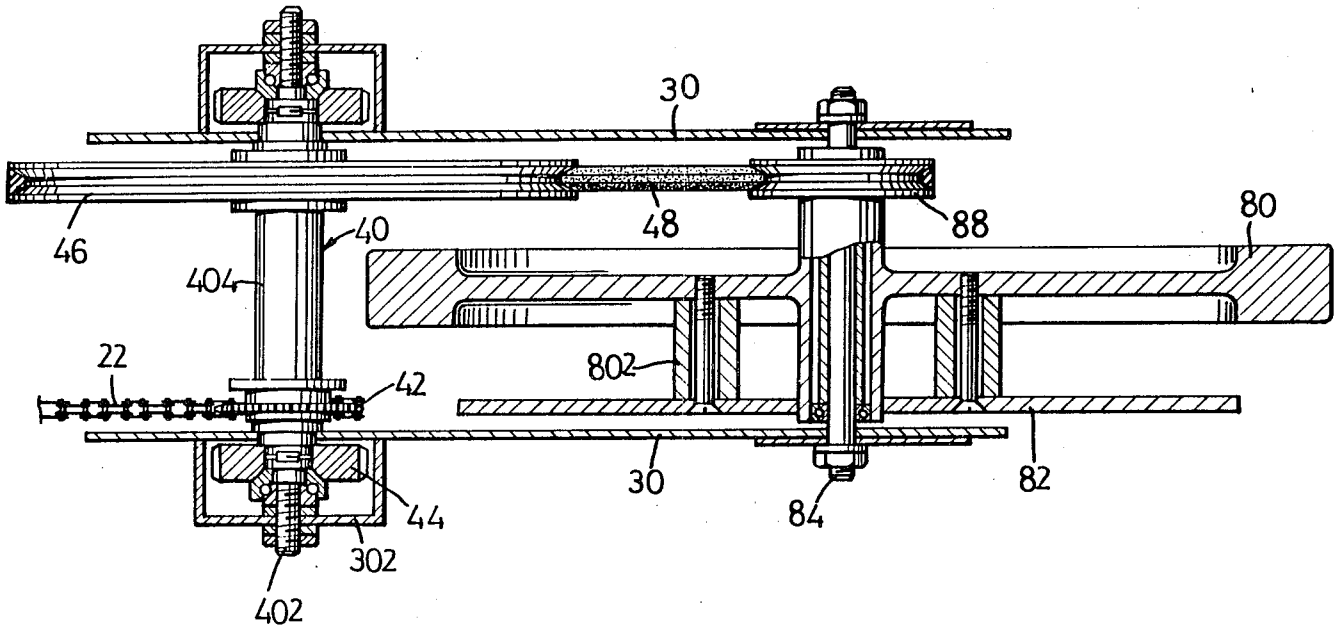
FIG. 4 is a cross-sectional view of the cycle exerciser of FIG. 1 as seen from line IV—IV.

A compound shaft 40 with threaded ends on a stationary shaft 402 thereof is fixedly secured to the cover plates 302 by nut and washers, as best seen in FIGS. 3 and 4. A one-way procket 42 and a pair of one-way pinions 44 are rotatably mounted on a hub 404 of the compound shaft 40. The pair of one-way pinions 44 are placed outside the frame plates 30 and within the cover plates 302. The pedaling means 20 comprises right and left pedals 202, pedal crank arms 204, and a driving sprocket 206. The hub 404 is rotated by the pedaling means 20 through a chain 22 and the one-way sprocket 42.

A connecting means 60 is provided to interconnect the two lever arms 70 to the two corresponding opposite ends 322 of the support rod 32 by a pair of toothed elements 50. The connecting means 60 comprises a substantially cylindrical swivel block 62 and a torsional spring 64. The swivel block 62 has a rim portion 622 for fixedly securing to the toothed element 50 and a protruding swivel shaft 624 for telescopically receiving a hollow-cylindrical portion 72 of the lever arm 70. The torsional spring 64 interconnects between the swivel block 62 and the lever arm 70 and forces the lever arms 70 toward the cycle exerciser. The connecting means 60 fixedly secures to the toothed element 50 at the rim portion 622 by screws or the like, which in turn rotatably mount on the ends 322. The toothed element 50 forms an arcuate toothed portion to engage with and drive the one-way pinion 44. The hub 404, therefore, may also be turned by the lever arms 70 through the one-way pinions 44. The connecting means 60 allows the lever arms 70 to swivel laterally relative to the cycle exerciser through the engagement between the protruding swivel shaft 624 and the hollow cylindrical end portion 72 of the lever arm 70.

The energy absorbing wheel 80, together with a coaxial brake disk 82, is fixedly mounted on an axle 84. The brake disk 82 is secured to the energy absorbing wheel 80, for example, by screws and sleeves 802, such that the brake disk 82 and the energy absorbing wheel 80 are spaced to allow a fork-type brake 86 to cooperate with the brake disk 82. The axle 84 is fixed to the frame plates 30 at the respective lower portions of the frame plates 30. The energy absorbing wheel 80 is rotated by the pedaling means 20 and/or both the lever arms 70 as desired which will be further described hereinbelow.

Referring further to FIGS. 1 and 2, the set of closed bars 18 disposed on the frame 10 are utilized to limit the oscillatory and swiveling movement of the lever arms 70 and simultaneously prevent the toothed element 50 from disengaging from the one-way pinion 44. The seat 14 further comprises a resilient seat back 142 and the frame 10 is further disposed with a pair of foot rests 16 to facilitate the boat-rowing operation of the cycle exerciser of this invention which is further described hereinbelow.

Figure 5:
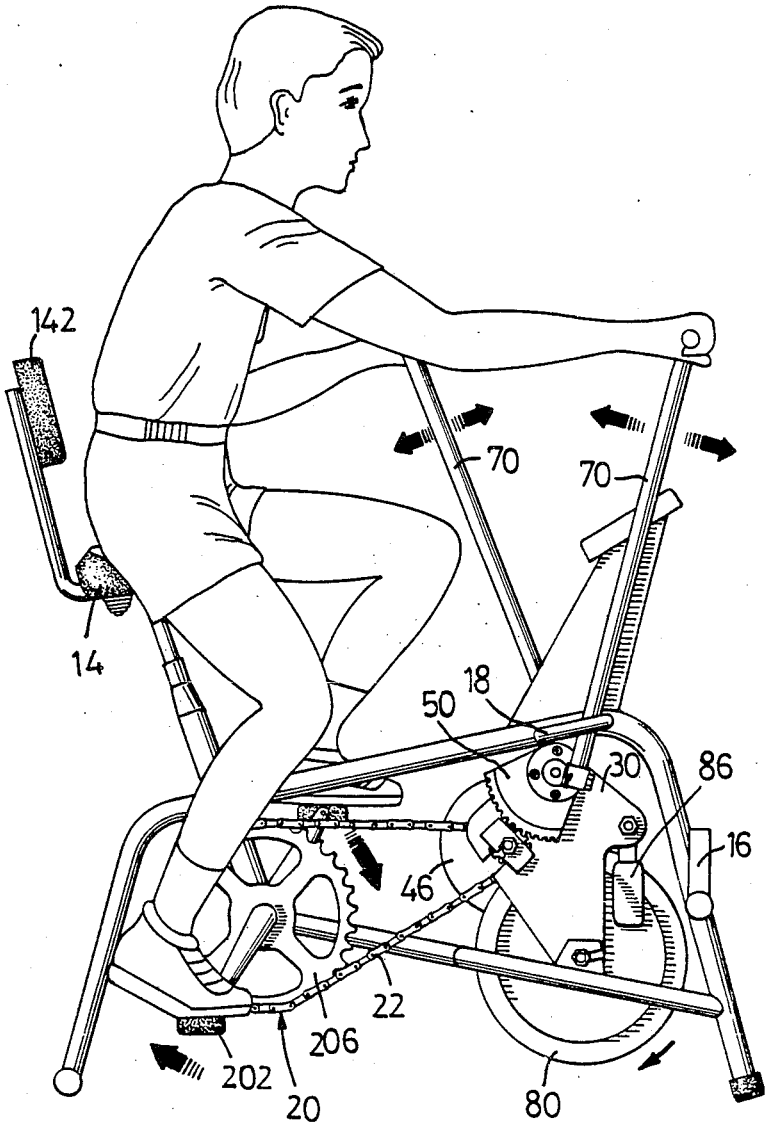
FIG. 5 is a view similar to FIG. 1 but showing the cycle exerciser in operation.

Still referring to FIG. 5, it is shown that the pedaling means 20 and both the lever arms 70 can be operated to rotate the energy absorbing wheel 80 in a clockwise direction. Also referring to FIGS. 3 and 4, it is noted that the sprocket 42 can urge the hub 404 to turn the energy absorbing wheel 80 only in a clockwise direction and the hub 404 is freely rotatable or does not turn the energy absorbing wheel 80 in a counterclockwise direction, the pedaling means 20, the right and left lever arms 70 therefore rotate the energy absorbing wheel 80 in one way; i.e., in a clockwise direction only. FIG. 4 shows that a pulley 46 and a pulley 88, fixed on the hub 404 and the axle 84 respectively and encompassed by a belt 48, constitute means to link the pedaling means 20 to the energy absorbing wheel 80. Although the pulleys 46, 88 and the belt 48 are utilized, in the present embodiment, to transmit rotational movement of the hub 404 to the energy absorbing wheel 80, it is to be realized that they can be replaced by sprockets and chain or the like to effect the same result.

Figure 6:
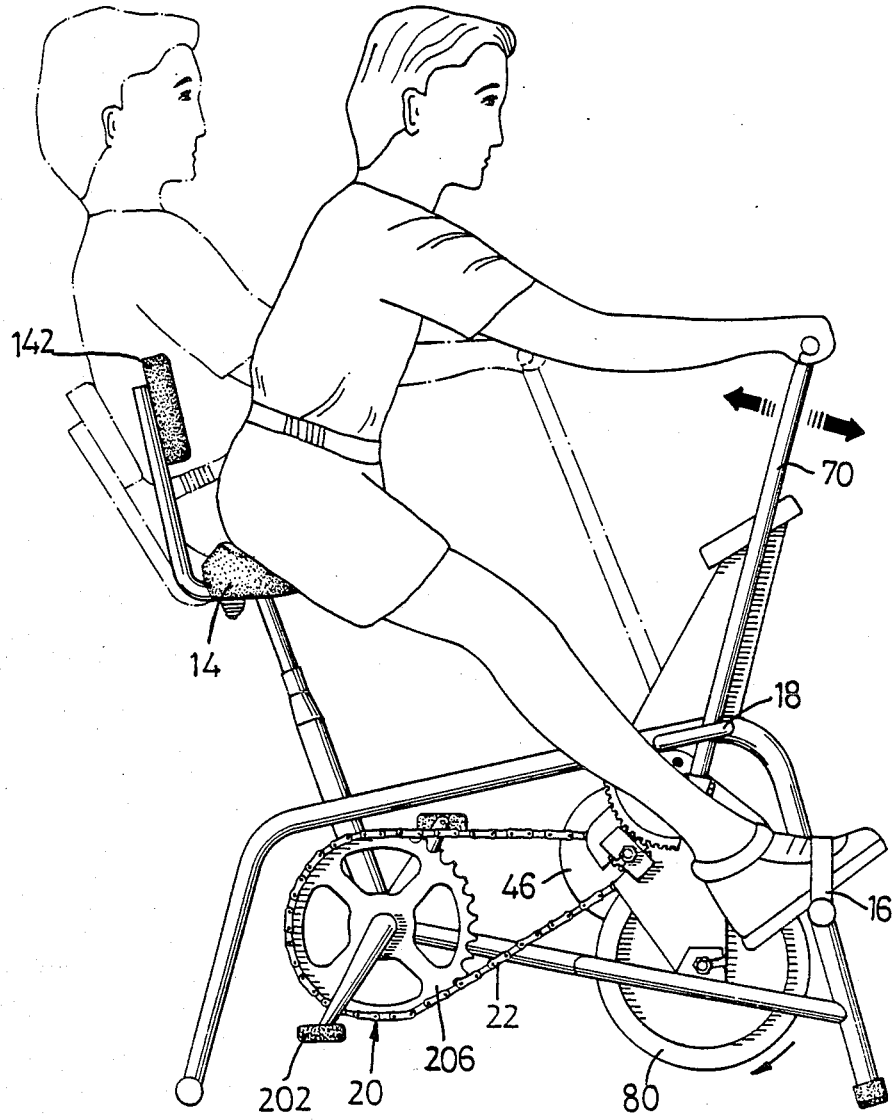
FIG. 6 is a view similar to FIG. 5 but showing the cycle exerciser in boat-rowing movement.

Shown in FIG. 6 is the boat-rowing operation of the cycle exerciser of this invention. The resilient seat 142 and the foot rests 16 are provided to facilitate such operation. The ends 322 of the support rod 32 (best shown in FIG. 3) and the protruding swivel shaft 624 serves as a pivotal point for oscillatory and swiveling movement of the lever arms 70 respectively. During this operation, backward movement of the lever arm 70 is resisted by the engagement between the toothed element 50 and the one-way pinions 44, but forward movement of the lever arm 70 allows the toothed element 50 to idly rotate the one-way pinion 44. Backward movementis resisted by the torsional spring 64 as explained above, such that sideward or lateral movement and backward movement of the lever arm 70 can take place simultaneously.

Figure 7:
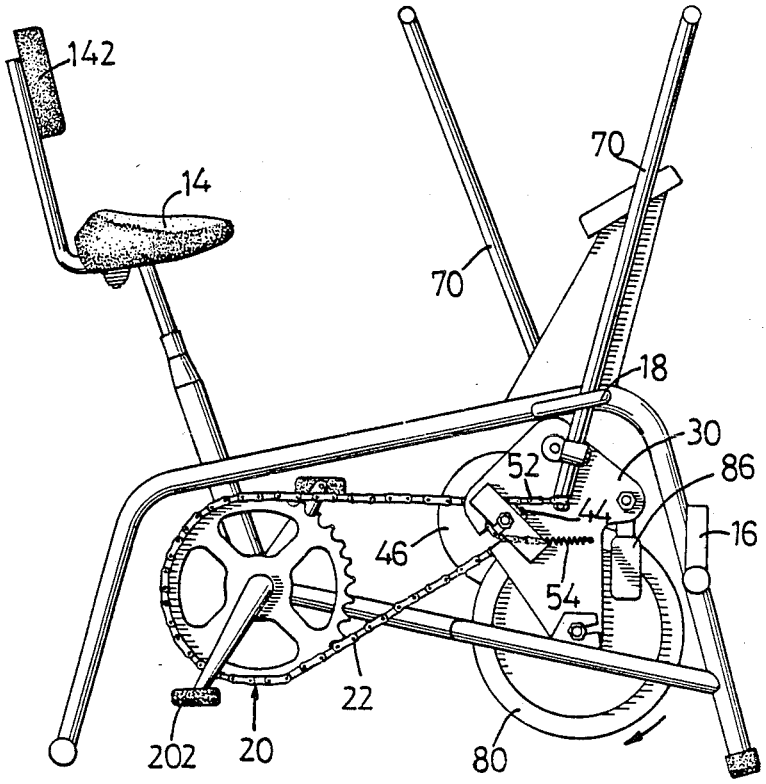
FIG. 7 shows an alternative embodiment of the present invention employing a drive chain in serial to a spring rather than the toothed element seen in FIGS. 1 to 6.

FIG. 7 shows an alternative embodiment of the cycle exerciser of this invention wherein the toothed elements 50 are replaced by the comination of a serially connected driving chain 52 and spring 54. The combination of driving chain 52 and spring 54 is disposed between one end of said lever arm 70 and the frame plate 30, with one end of the driving chain 52 fixed on the lever arm 70 and one end of the spring 54 fixed on the frame plate 30. The driving chain 52, which engages and rotates the one-way pinion 44, is now utilized to turn the hub 404 in this embodiment.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A cycle exerciser having a frame with a pair of supporting plates extending downward therefrom, a seat, pedaling means, an energy absorbing wheel and means to link the pedaling to the energy absorbing wheel, wherein the improvement comprises:

a pair of frame plates being respectively secured to said supporting plates of the frame by a support rod, a lower portion of said frame plates also being secured to the frame, said support rod being fixedly disposed across said pair of frame plates with two opposite ends extending outward from said frame plates, a respective cover plate being fixed on each of said frame plates;

a compound shaft including a stationary shaft and a hub, said stationary shaft being secured to said cover plates, said hub having a one-way sprocket and a pair of one-way pinions rotatably mounted thereon, said hub being rotated by the pedaling means through a chain and said one-way sprocket; and connecting means for interconnecting two lever arms to said two opposite ends of said support rod by a pair of toothed elements, said connecting means allowing said lever arms to swivel laterally, said toothed elements engaging and driving corresponding one-way pinions to turn said hub;

said energy absorbing wheel being fixedly mounted on an axle with a coaxial brake disk, said brake disk being secured to and rotatable with said energy absorbing wheel, said axle being fixed to said frame plates at said respective lower portions of said frame plates, said energy absorbing wheel being rotated by the pedaling means and/or said lever arms.

2. A cycle exerciser as claimed in claim 1, wherein said connecting means disposed between said respective lever arm and toothed element comprises a substantially cylindrical swivel block and a torsional spring, said swivel block having a rim portion for fixedly securing to said toothed element and a protruding swivel shaft for telescopically receiving an end portion of said lever arm, said torsional spring being connected between said end portion and said swivel block, said torsional spring enabling said lever arm to swivel toward the frame.

3. A cycle exerciser as claimed in claim 2, wherein the frame further has a set of closed bars disposed thereon to limit an oscillatory and swiveling movement of said lever arms and simultaneously prevent said toothed element from disengaging said one-way pinion.

4. A cycle exerciser as claimed in claim 1, wherein said seat further comprises a resilient seat back and wherein said frame is further disposed with a pair of foot rests.

* * * * *